US007986237B2

(12) United States Patent
Jung

(10) Patent No.: US 7,986,237 B2
(45) Date of Patent: Jul. 26, 2011

(54) LOCATION MANAGEMENT METHOD USING RFID SERIES

(75) Inventor: Hyun-Chul Jung, Saha-gu, Busan (KR)

(73) Assignee: Hyun-Chul Jung, Busan (KR)

( * ) Notice: Subject to any disclaimer, the term of this patent is extended or adjusted under 35 U.S.C. 154(b) by 361 days.

(21) Appl. No.: 12/160,577

(22) PCT Filed: Jan. 8, 2007

(86) PCT No.: PCT/KR2007/000132

§ 371 (c)(1),
(2), (4) Date: Jul. 10, 2008

(87) PCT Pub. No.: WO2007/081129

PCT Pub. Date: Jul. 19, 2007

(65) Prior Publication Data

US 2009/0002128 A1 Jan. 1, 2009

(30) Foreign Application Priority Data

Jan. 11, 2006 (KR) ..... 10-2006-0002976

(51) Int. Cl.
*G08B 13/14* (2006.01)

(52) U.S. Cl. ..... 340/572.1; 340/10.1; 340/825.49; 702/57; 455/41.2

(58) Field of Classification Search ..... 340/988, 340/995, 933, 941, 10.1, 572.1, 825.49, 572.8; 701/200–226; 180/167, 169; 702/57; 455/41.2
See application file for complete search history.

(56) References Cited

U.S. PATENT DOCUMENTS

| | | | | |
|---|---|---|---|---|
| 5,006,010 | A * | 4/1991 | Duckett | 404/12 |
| 5,054,648 | A * | 10/1991 | Luoma | 221/185 |
| 5,213,464 | A * | 5/1993 | Nicholson et al. | 414/440 |
| 5,244,334 | A * | 9/1993 | Akita et al. | 414/502 |
| 6,394,080 | B1 * | 5/2002 | Zavala | 125/13.01 |
| 6,435,369 | B1 * | 8/2002 | Poursayadi | 221/185 |
| 6,577,246 | B1 * | 6/2003 | Handa et al. | 340/901 |
| 6,726,434 | B2 * | 4/2004 | Orthaus et al. | 414/539 |
| 7,106,179 | B1 * | 9/2006 | Dueker et al. | 340/321 |
| 7,245,227 | B2 * | 7/2007 | Winter et al. | 340/686.2 |
| 7,420,457 | B2 * | 9/2008 | Bode et al. | 340/10.1 |
| 2003/0210975 | A1 * | 11/2003 | Garcia | 414/467 |
| 2007/0120670 | A1 * | 5/2007 | Torchalski | 340/572.1 |
| 2008/0068164 | A1 * | 3/2008 | Campbell | 340/572.1 |

FOREIGN PATENT DOCUMENTS

| | | | |
|---|---|---|---|
| JP | 05-134741 | A | 6/1993 |
| JP | 2003-098253 | A | 4/2003 |
| KR | 10-2005-0006687 | A | 1/2005 |
| KR | 10-2005-0008179 | A | 1/2005 |

OTHER PUBLICATIONS

International Search Report for PCT/KR2007/000132 filed Jan. 8, 2007.
Written Opinion of the International Searching Authority for PCT/KR2007/000132 filed Jan. 8, 2007.

* cited by examiner

*Primary Examiner* — Benjamin C Lee
*Assistant Examiner* — Quang Pham

(57) ABSTRACT

The present invention relates to a method of location management on the road using RFID series. In particular, the present invention provides RFID series, where a number of RFID tags are concurrently installed without the need of installing RFID tags one by one and ID of each RFID tag is automatically computed, and therefore work can be completed with a little time and workforce without confusion even where a number of RFID tags are required in order to constitute an RFID system, and a method of location management on the road to specifically grasp the location where an optional thing on the road (e.g. a car) stops or moves using the RFID series.

3 Claims, 3 Drawing Sheets

【Figure 1】
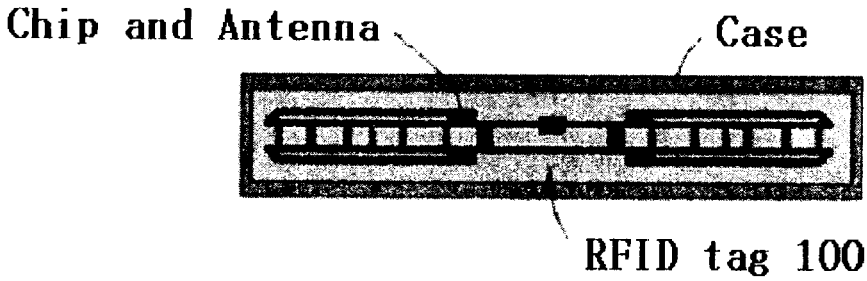
【Figure 2】
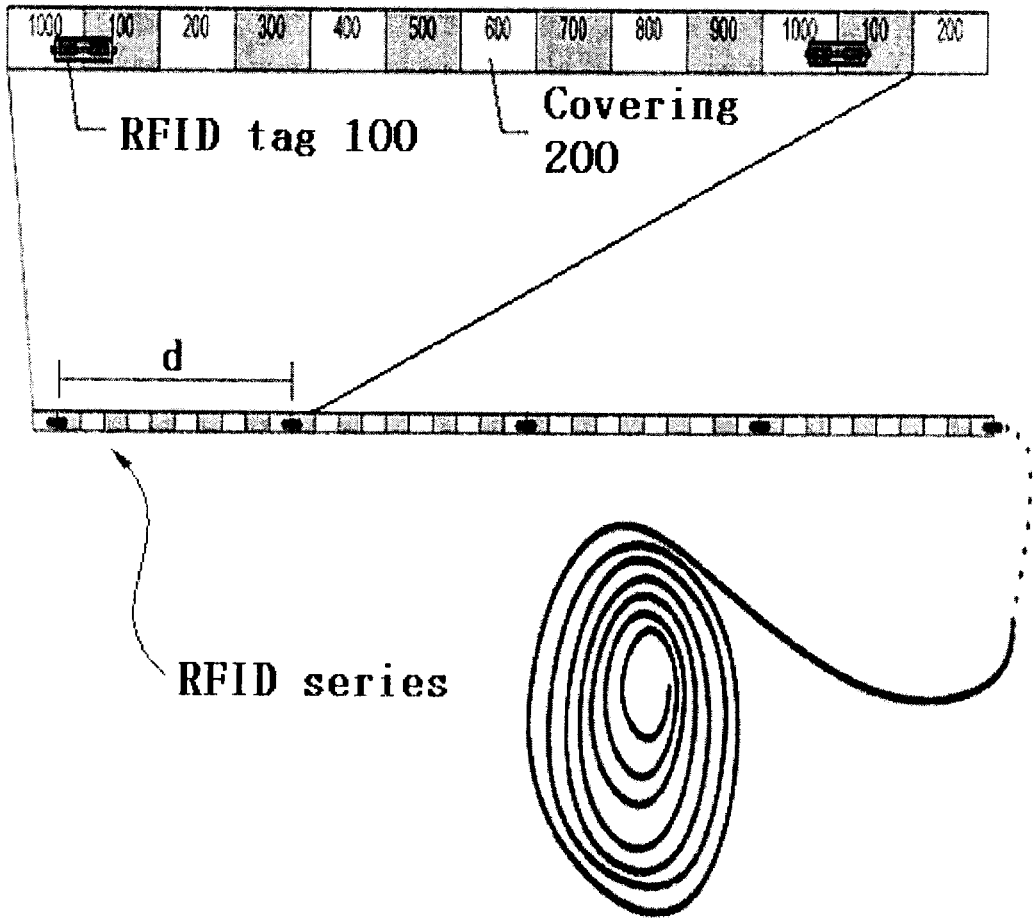

【Figure 3】
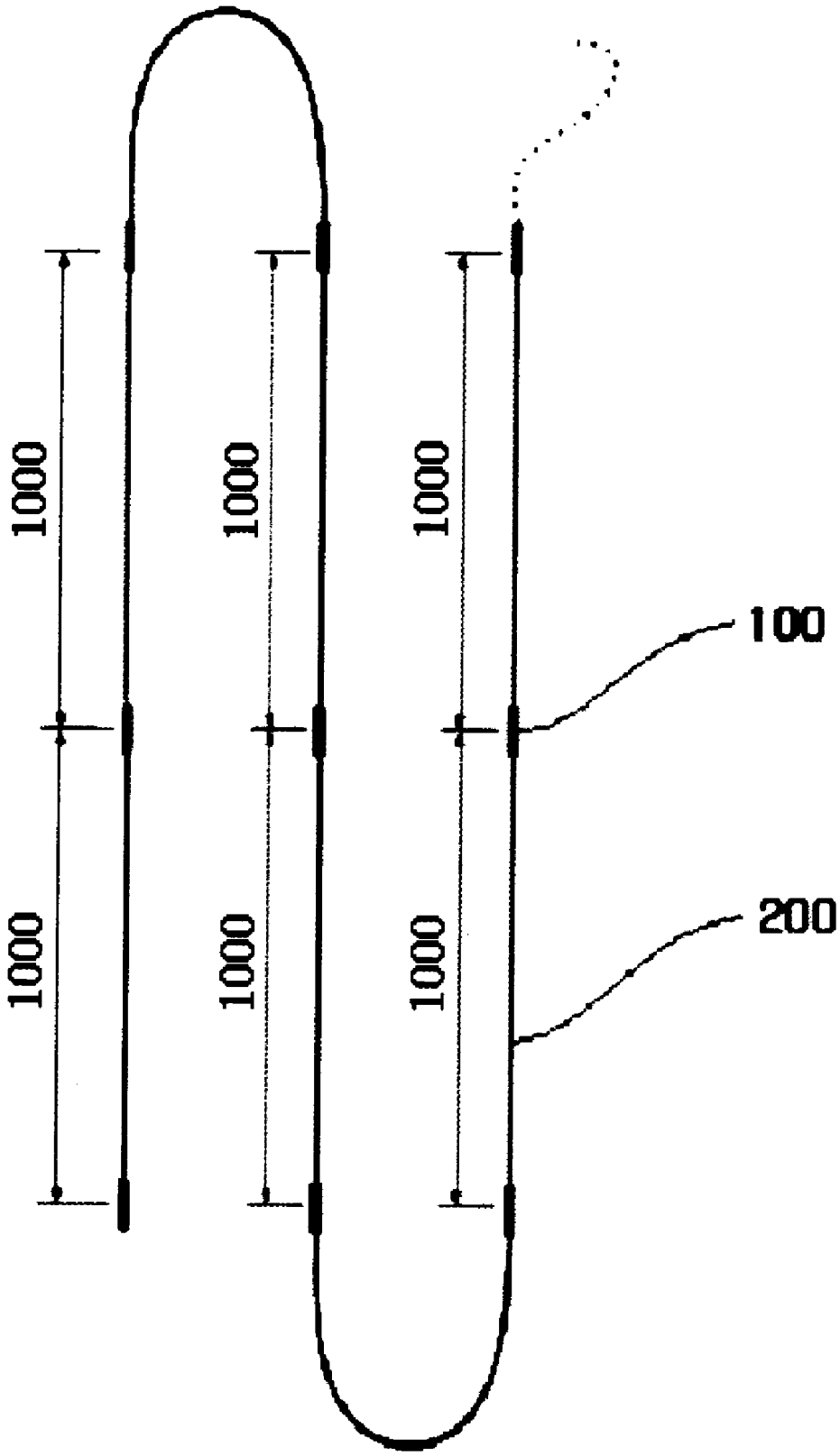

LOCATION MANAGEMENT METHOD USING RFID SERIES

TECHNICAL FIELD

The present invention relates to a method for constructing a location management, system using RFID series, and belongs to the field of a radio communication using RFID.

BACKGROUND ART

An Radio Frequency IDentification (hereafter, referred to as "RFID") system is a kind of a radio communication system which consists of RFID, an antenna, a reader and a writer, wherein the RFID is moved by attaching to an article and moves, and performs a radio communication with an antenna fixed on the ground or a building. The reader controls communication between an antenna and RFID or performs a protocol exchange between an upper-level device, such as a computer, and RFID. Recently, there are many readers with a built-in antenna.

RFID is one of the constituents of an RFID system. The RFID is required to satisfy the following three conditions concurrently: (i) the size should be convenient for carrying; (ii) information should be stored in an electronic circuit; and (iii) the communication should be made by non-contact communication. Accordingly, although a floppy disc, a magnetic card, a contact IC card, etc. are convenient to store data and to be carried, they are not included in RFID. Although RFID broadly covers a non-contact IC card (RF card), it generally refers to an RF tag.

RFID is used to identify an article, to which an RFID tag is attached, and information on the article. In other words, when and where a product exists, required information can be taken out and new information can be wrote clown, if necessary. When using RFID, we can save time spending in inquiring an information center of required information and receiving the response. Further, this RFID system has advantages, such as an easy distributed process of information and simplification of information system. In particular, an automatic identification means used in an automatic processing line should resist harsh environments, such as vibration and impact, water and oil, high temperature and dust, etc. under which RFID is suitable. Additionally, RFID is more suitable for the cases where batch production is made on one production line, and a frequent exchange of information on a target object is required. Although RFID was used as a substitution for a bar code at a relatively early logistics stage, such as a production process or a logistics center, it tends to be gradually extended to a final distribution stage, such a distribution stage.

The RFID tag refers to RFID attachable to an article, and is valuable in the field of an FA (Factory Automation). An RFID tag largely consists of a chip and an antenna, and has a completed shape through an encapsulation process to protect the RFID tag. The RFID tag has various shapes, such as a credit card, a stick, a coin, a label, etc., depending on an encapsulation method so that a user can select, a shape suitable for his/her purpose. The RFID tag is independently separated and manufactured in the shape of piece. Hereinafter, an RFID tag previously manufactured in the shape of piece is referred to as an "independent RFID tag."

However, where a plurality of RFID tags are required to form an RFID system (e.g., a location management system), the following problems are found in the previous independent RFID tag.

First, each of independent RFID tags has the same appearance and thus is not distinguishable from one another.

Second, even where RFID lags constituting the RFID system are installed at fixed intervals, they should be individually installed one by one, which is very cumbersome.

Third, in order to confirm ID of each independent RFID tag in the process of installing independent RFID tags, a user should read the tags one by one. Further, even if ID is wrote down on the surface of each independent RFID tag in or after the process of encapsulation of RFID, it is difficult to keep the order of these tags in the process of installation because these independent RFID tags are separated from one another one by one. Further, once the order has been scattered, management is more difficult.

Fourth, the more the plurality of independent RFID lags to be installed increases, the more seriousness of these problems increases.

Therefore, considerable time and workforce are required in order to install independent. RFID tags, and at the same lime unnecessary confusion is generated.

DISCLOSURE

Technical Problem

The present invention has been suggested to solve the above-mentioned problems, and provides RFID series, wherein a number of RFID tags are concurrently installed without the need of installing RFID tags one by one and ID of each RFID tag is automatically computed, and therefore work can be completed with a little time and workforce without confusion even where a number of RFID tags are required in order to constitute an RFID system, and a method of location management on the road to specifically grasp the location where an optional thing on the road (e.g., a car) stops or moves using the RFID series.

Technical Solution

In order to accomplish the above-mentioned objective, the present invention provides a method of location management on the road, wherein the location connecting optional two points (a, b) on the road is managed, in RFID series is encapsulated in the shape of string after wrapping a number of RFID tags with a covering, where the RFID tags are continuously arranged at regularly spaced intervals (d), and a division or a color indicating connect ion intervals (d) between the RFID tags is coded on the covering, comprising: hollowing out serial grooves between the optional two points (a, b) and bury RFID series S110: reading and recording IDs of the head (a) and the end (b) of the buried RFID series by use of an RFID reader S120; monitoring and inputting the arrangement order of RFID tags in the database S130; reading an RFID tag at an optional point (objective RFID tag) by use of an RFID reader S140; and monitoring that the objective RFID tag is an RFID tag located on $n^{th}$ from the RFID tag located on the head (a) and confirming that the objective RFID tag is located at L from the head (a) where L is resulted from multiplying n and d S150.

ADVANTAGEOUS EFFECTS

According to the present invention, an RFID system for location management on the road with a little time and workforce by concurrently installing a number of RFID tags without the need of installing RFID tags one by one on the ling road can be constructed and the location where an optional thing (e.g., a car) on the road stops or moves can be promptly and clearly grasped and managed through the RFID system.

DESCRIPTION OF DRAWINGS

FIG. 1 shows RFID tags of RFID series according to one exemplary embodiment of the present invention.

FIG. 2 shows a covering of RFID series and an encapsulated RFID series with a plurality of RFID tags wrapped by the covering.

FIG. 3 is a conceptual view showing installation of a number of RFID tags using the RFID series according to the present invention.

BEST MODE

Figure 4:
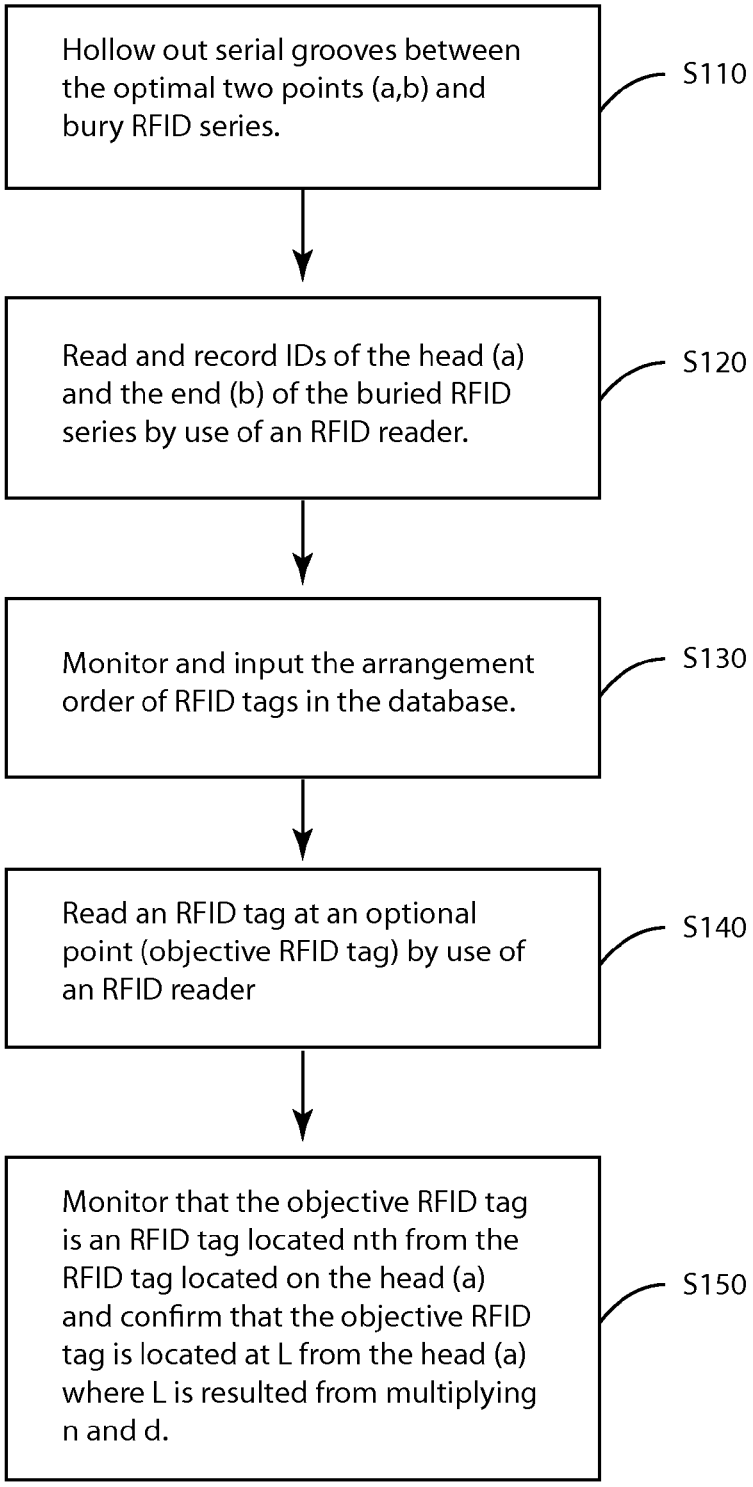
FIG. 4 is a flow chart showing a location management method using RFID series according to the present invention.

FIG. 1 shows RFID tags of RFID series according to one exemplary embodiment of the present invention.

RFID tags 100 includes a chip and an antenna, which are surrounded by a case to protect them. The constitution of these RFID tags 100 is identical to that of the conventional RFID tags, and thus a detailed description thereof will be omitted. However, the RFID tags 100 according to the present, invention should be wrapped by a covering 200, which will below explained, and be encapsulated in the shape of string. Thus, it is desirable that a case be made of an adhesive label, which is attachable to the covering 200.

FIG. 2 shows a covering of RFID series and an encapsulated RFID series with a plurality of RFID tags wrapped by a covering.

A covering 200 wraps a plurality of RFID tags 100 and encapsulates them in the shape of string. In other words, the plurality of RFID tags 100 are arranged, and then they are wrapped by a covering 200 at a time to form an RFID tag connecting body, which looks like a long electric wire (hereinafter referred to as "RFID series"). If a case of RFID tags 100 is made of an adhesive label, which can be well attached to a covering 200, a process of encapsulating the plurality of RFID tags 100 will be more easily performed. That is, in this case, RFID series according to the present invention can be manufactured simply by attaching RFID tags 100 to the covering 200 without the need of allowing the covering 200 to wrap the plurality of RFID tags 100. Such covering 200 is made of bendable soft materials and is in the shape of a longitudinally droopy RFID.

The RFID series according to the present invention varies depending on the type of RFID tags 100, which is classified based on the technical difference, such as frequency band, etc., intervals between RFID tags 100, quality of a covering 200, etc.

In the RFID series, it is desirable to continuously arrange RFID tags 100 at fixed intervals. There was a problem of requiring considerable time and workforce in the conventional RFID system because a worker should install each of the independent RFID tags one by one, even in the case where RFID tags constituting the RFID system are installed at fixed intervals. To resolve such problem, installation of only one RFID series in a certain space can exhibit, an effect of concurrently installing a plurality of RFID tags 100 at fixed intervals (d), in the case where RFID tags 100 on the RFID series are continuously arranged at fixed intervals (d). As such, the necessity of continuously arranging RFID tags 100 at fixed intervals (d) is not limited only to the above reason, which will be explained in detail below.

The connection intervals (d) between RFID tags 100 on RFID series are not limited to one numerical value. That is, RFID series can be manufactured by varying the connection intervals (d) between RFID tags 100 according to purpose or use, etc. In such a case, one who intends to install an RFID system can selectively purchase and install RFID series having connection intervals (d) between RFID tags 100 corresponding to required RFID installation intervals (d). RFID series wherein the connection intervals (d) between RFID tags 100 are 1000 mm will be explained with reference to FIG. 2.

In this case, it is desirable to code a division or a color indicating connection intervals (d) between the RFID tags 100 on a covering 200 of RFID series according to the present invention. If the division or the color is coded on the surface of the covering 200, a worker can easily recognize the intervals at which RFID tags 100 are arranged in the RFID series intended to be installed by the worker. Thus. RFID series having the connection intervals (d) between various RFID tags 100 can be clearly distinguished from each other. There is no possibility of creating confusion in purchasing or installing RFID series. Further, we can clearly grasp the process of installing RFID series in a certain space or the installation location and quantity of RFID tags 100 after installation. For reference, FIG. 2 shows the state where each of the continuously arranged RFID tags 100 is divided into ten; a color is intersected at the interval of 100 mm; and a division of a 100 mm unit is marked on each tag to show information that the connection interval (d) between RFID tags 100 on the concerned RFID series is 1000 mm.

Further, in the RFID series according to the present invention, it is desirable to continuously arrange RFID tags 100 in the ID order. This is because the conventional RFID series has the following disadvantages: In the process of installing independent RFID tags, each RFID tag should be read one by one by use of an RFID reader in order to confirm ID of each of the independent RFID tags. Even if ID is wrote down on the surface of each of the independent RFID tags in or after the process of encapsulating RFID, it is difficult to keep their order (the order of series plurality of ID of each independent RFID tag) in the process of installation because these independent RFID tags are separated one by one, and it is more difficult to manage these tags after separation. To resolve these problems, following advantages are provided. In the case where RFID tags on the RFID series are continuously arranged in the ID order, once a worker installs one of the RFID series in a certain space, and then reads the head RFID tag 100 ID and the end RFID tag 100 of the installed RFID series, IDs of the RFID tags 100 between the head and the end will be arranged in the ascending order from the head RFID tag 100 ID or in the descending order from the end RFID tag 100 ID. Thus, IDs of all RFID tags 100 can be automatically grasped at a time without confirming ID of each independent RFID tag.

If it is not possible to manufacture RFID series according to the present invention by continuously arranging RFID tags 100 in the ID order, the following method is available.

(1s) RFID series is prepared by arranging RFID lags 100 at random regardless of the ID order.

(2s) Database is prepared by reading and recording IDs of RFID tags 100, which are arranged on the RFID series formed in the process of (1s), in turns (hereinafter referred to as "RFID tag ID arrangement information"). For instance, the RFID tag ID arrangement information may be constituted by the following form. 1: ID253, 2: ID20, 3: ID7, 4: ID154, 5: ID34, 6: ID817. 7: ID6732, 8: ID470, 9: ID78, . . . .

(3s) A seller of RFID series provides a consumer of RFID series with RFID tag ID arrangement information formed in the process of the above (2s) through various recording media. For instance, a seller of RFID series may be able to provide a consumer with a diskette containing RFID tag ID arrangement information of the concerned RFID series concurrently with selling RFID series. In this case, a consumer of RFID series can easily find out IDs of RFID tags 100 around the RFID tag 100 by monitoring RFID tag ID arrangement information after reading ID of one of several RFID tags 100 connected on the RFID series. Meanwhile, it is desirable to monitor the RFID tag ID arrangement information through the Internet. That is, if a consumer of RFID series enters the website of a seller (or a manufacturer) of RFID series and inputs IDs of the head RFID tag and the end RFID tag of the purchased RFID series, a server of a seller (or a manufacturer) of RFID series may provide a consumer with RFID tag ID arrangement information on RFID tags existing between inputted two RFID tags. The above method may exhibit the same effect as the effect obtained when continuously arranging RFID series in the ID order of RFID tags 100.

In the meantime, it is more desirable to write down ID and the arrangement order of RFID tags 100 on a covering 200. If ID and the arrangement order of RFID tags 100 are wrote down on the surface of a covering 200, efficiency will more increase since a worker can perform installation by promptly recognizing RFID tag 100 information included in RFID series that he is installing.

Such utility of RFID series can be more specifically understood as set forth below.

First, although a process of dividing a space in order to install a plurality of RFID tags in an intended space is required, the dividing process may be omitted because the length is marked and a color is coded on RFID series. That is, once a worker simply determines an interval to install RFID tags, selects and installs RFID series having an interval property (i.e., connection intervals between RFID tags 100) corresponding to the interval, the length indication on RFID series will naturally have a function of dividing a space.

Second, in order to obtain information on the concerned zone by reading RFID tags after attaching RFID tags to each of the divided zones, a process of matching a zone ID and ID of RFID tag installed in the zone in advance is required. In case of using independent RFID tags, a process of matching a zone ID and ID of RFID tag one by one by actually reading IDs of all of the installed RFID tags using an RFID reader after installing RFID tags in each zone was required. This process was essentially required because it is not possible to distinguish general independent RFID tags with the naked eye. In replace of this process, we may consider reading all the RFID tags prior to installation of RFID tags, predetermining zones to which each RFID tag is attached, and writing down with a pen or printing a ID zone on the surface of a RFID tag. However, this work is also very cumbersome and is likely to generate confusion.

When using RFID series, we may omit a process of reading ID by use of an RFID reader because ID of RFID tag 100 on RFID series is already known. Further, we may simply assign ID in order to correspond to RFID tag 100 ID after installing RFID series.

Where a road is divided into zones and RFID tags to indicate each zone are attached to the zones in order to manage the location of a long road, the following steps are required, if independent RFID tags are used:

(1) Determine the length of a zone of a road.

(2) Mark zones on the road by measuring the length determined in above (1) with a ruler and assign ID to each zone (zone ID).

(3) Prepare the same plurality of RFID tags as the plurality of divided zones.

(4) Attach the prepared RFID tags to each zone one by one.

(5) Read IDs of RFID tags attached to each zone by use of an RFID leader and input them in the database.

(6) Confirm ID of zone to which a RFID tag read in above (5) is attached, and match it with RFID tag ID on the database.

(7) Repeal above (5) and (6) until all of the attached RFID tags are read.

The foregoing steps are very cumbersome and are likely to generate confusion when increasing the quantity of RFID tags. In particular, steps (2), (4), (5), and (6) are very labor intensive.

However, the above steps may be easily and effectively performed by use of RFID series according to the present invention. FIG. 3 shows a state where a plurality of RFID tags are installed in an intended space by use of RFID series according to the present invention, which is explained below.

(1a) Determine the length of a zone of a road.

(2a) Select RFID series having the interval property corresponding to the length determined in above (1) and install it on the road.

(3a) Read and record IDs of RFID tags at the head and the end of RFID series installed in above (2a). In this time, it is not necessary to separately read IDs and the arrangement order of RFID tags between the head RFID tag and the end RFID tag because RFID series provides them as its basic properties at the outset. Further, a zone of the road is automatically marked by the length marking division of RFID series phase. In other words, a process of dividing zones one by one by measuring them as in the prior art is not required (4a) Input ID of RFID tag provided together with RFID series in the database, assign zone ID corresponding to ID of RFID in the zone ID order, and match them.

The above method is more simple and effective than the method of using the conventional independent RFID tags on RFID series because the order of RFID tags of RFID series phase is fixed and the intervals are regular. That is, a process of marking a zone on the road is omitted. Further, it is not necessary to read all of the RFID tags one by one. Finally, a process of matching zone ID with RFID tag ID is simply resolved.

According to RFID series of the present invention, the technical problems of the conventional art can be resolved as follows.

First, a problem that each of independent RFID tags was not distinguished from each other can be resolved. That is, RFID series provides RFID tags 100, which are mutually connected by one line, and thus they are automatically distinguished.

Second, a problem that each of the independent RFID tags should be installed one by one can be resolved. That is, RFID series provides a plurality of RFID tags 100, which are connected integrally, and thus installation of one RFID series can exhibit an effect of concurrently installing a plurality of RFID tags 100.

Third, problems that an independent RFID tag should be read by use of an RFID reader for confirmation, and that independent RFID tags were separated can be resolved. That is, in RFID series, it is possible for RFID tags 100 to be arranged in the ID order in a row or for the arrangement order of the arranged RFID tag 100 ID to be separately monitored. Accordingly, once ID of one RFID tag 100 is read. IDs before and after the ID are automatically known. Furthermore, RFID series is integrally encapsulated by gathering a plurality of RFID tags 100, which does not create a problem of separating the tags.

Fourth, seriousness of a problem occurring when increasing the plurality of independent RFID lags can be resolved. That is, RFID series exhibits its valuable utility when increasing the plurality of RFID tags 100.

Fifth, there will be the effect of cost savings in process because a plurality of RFID tags 100 are encapsulated integrally rather than individually.

The present invention provides a method of location management on the road to specifically grasp the location where an optional thing (e.g., a car) on the road stops or moves by utilizing advantages of the RFID series. That is, the present invention provides a method of location management on the road, wherein the location connecting optional two points (a. b) on the road is managed, comprising: hollowing out serial grooves between the optional two points (a. b) and bury RFID series S110; reading and recording IDs of the head (a) and the end (b) of the buried RFID series by use of an RFID reader S120; monitoring and inputting the arrangement order of RFID tags in the database S130; reading an HFID tag at an optional point (objective RFID tag) by use of an RFID reader S140; and monitoring that the objective RFID tag is an RFID tag located on $n^{th}$ position from the RFID tag located on the head (a) and confirming that the objective RFID tag is located at L from the head (a) where L is resulted from multiplying n and d S150.

Where the arrangement order of the head RFID tag and the end RFID tag of the RFID series have already been known, it will not be required at step 130 to separately read the arrangement order of RFID tags between the head RFID tag and the end RFID tag. That is, if the arrangement order of the head RFID of RFID series is "1" and the arrangement order of the end RFID tag is "100000." the arrangement order of RFID tags between the head RFID tag and the end RFID tag will be "2, 3, 4 . . . 99997, 99998, 99999" in the ascending order, and thus a worker may simply input the result value in the database.

At step 140, a process of reading objective RFID tags can be performed by attaching an RFID reader to an objective thing (e.g. a car) that passes on the road as an object of which location is monitored and managed and continuously tracing the RFID reader with respect to the RFID series installed on the road to continuously read RFID tags.

At step 150, a process of confirming the location of an objective RFID tag, e.g., if an objective RFID tag is an RFID tag located on $5600^{th}$ (n) position from the RFID tag located on the head and the connection interval (d) between an RFID tag 100 is 1 meter, it can be confirmed that an objective RFID tag is located 5600 meter (L), which is the result value of multiplying 5600 (n) from the RFID tag located on the head and 1 meter (d), from the RFID tag located on the head. In other words, it means that a car, etc. exists on the location currently confirmed on the road.

Meanwhile, the present invention may add step 160 to monitor and input IDs of RFID tags in the database and to assign IDs of RFID tags and zone IDs and match them after step 130.

Where IDs of the head RFID tag and the end RFID tag of RFID series have already been read and recorded, it is not necessary to separately read IDs of RFID tags between ID of the head RFID tag and ID of the end RFID tag because these IDs are provided as a basic property at the outset. That is, a manager may arithmetically infer IDs corresponding to the arrangement order of RFID tags between the head RFID tag and the end RFID tag of RFID series, or simply confirm and input IDs of RFID tags wrote down on the covering 200, without, the need of a process of reading and confirming the installed independent RFID tags one by one by use of an RFID reader as in the prior art. Where RFID tags of RFID series phase are not continuously arranged in the ID order, a manager may simply monitor and input RFID tag ID arrangement information of the concerned RFID series.

As an example of the case where RFID tags of RFID series phase are continuously arranged in the ID order, if the arrangement order of the head RFID tag of RFID series and its corresponding ID are "1" and "ID1," respectively, and the arrangement order of the end RFID tag and its corresponding ID are "100000" and "ID100000," respectively, the arrangement order of RFID tags between the head RFID tag and the end RFID tag of RFID series and their corresponding IDs will be "2, 3, 4, . . . 99997, 99998, 99999" and "ID2, ID3, ID4, . . . , ID99997, ID99998, ID99999," respectively in the ascending order, and a manager may simply input the result value in the database. As an example of the case where RFID tags of RFID series phase are arranged at random regardless of the ID order, if IDs of the head RFID tag of RFID series is "ID7" and ID of the end RFID tag is "ID78" and the RFID tag ID arrangement information of the concerned RFID series is " . . . 2: ID1003, 3: ID7, 4: ID154, 5: ID34, . . . 100000: ID6732, 100001: ID470, 100002: ID78, 100003: ID551, . . . " IDs of RFID tags of the concerned RFID series phase will be "ID7, ID154, ID34, . . . , ID6732, ID470, ID78," respectively, and a manager may simply input the result value in the database.

Further, a process of matching IDs of RFID tags and zone IDs at step 160 can also be performed by assigning zone IDs corresponding to IDs of the confirmed RFID tags of the RFID series phase at a time, without the need of reading the installed independent RFID tags by use of an RFID reader, confirming the IDs, and assigning zone IDs corresponding to the confirmed RFID tags of the RFID series phase one by one, as in the prior art. That is, as seen from the above example, where IDs of RFID tags of RFID series phase are arranged in turns as "ID1, ID2, ID3, . . . , ID99998, ID99999, ID100000." or even where the IDs are arranged at random as "ID7, ID154, ID34, . . . ID6732, ID170, ID78," a manager simply may input the number of zone IDs in accord with the number of RFID lags as "zone1, zone2, zone3, . . . zone99998, zone99999, zone100000" in turns in the database, and then IDs of RFID tags and zone IDs will be matched as they are.

Meanwhile, it is desirable that such a zone ID include area names where RFID tags 100 of RFID series installed on the road according to an administrative district or the distance of the concerned RFID tags 100 from the head RFID tag of RFID series installed on the road. Since a manager can promptly recognize the name of the area where a car passes on the road or the distance apart, confirmation and management of the location of a car can be more promptly and conveniently conducted.

The foregoing embodiments are merely exemplary, and many alternatives, modifications and variations within the scope of the essentials of the present invention will be apparent to a person having ordinary skill in the art to which the present invention pertains. Accordingly, the examples disclosed in the present invention and attached drawings are provided not to limit, but to explain the technical feature of the present invention. The technical feature of the present invention is not limited by these examples and attached drawings. The scope of protection for the present invention should be interpreted based on the claims below and all of the technical features within the equivalent scope should be interpreted to be included in the scope of the present invention.

INDUSTRIAL APPLICABILITY

The present invention is to provide RFID series constituting an RFID system that can complete work with a little time and workforce without confusion, even when a plurality of RFID tags are required, by concurrently installing a plurality of RFID tags without the need of installing RFID tags one by one and simultaneously computing automatically ID of each RFID. Accordingly, if the present invention is introduced into logistics management or warehousing field, its practical and economic value can be sufficiently accomplished.

The invention claimed is:

1. In RFID series encapsulated in the shape of string after wrapping a number of RFID tags with a covering, where the RFID tags are continuously arranged at regularly spaced intervals (d) and a division or a color indicating connection intervals (d) between the RFID tags is coded on the covering, a method of location management on the road, wherein the location connecting optional two points (a, b) on the road is managed, comprising:

(a) hollowing out serial grooves between the optional two points (a, b) and bury RFID series;

(h) reading and recording IDs of the head (a) and the end (b) of the buried RFID series by use of an RFID reader;

(c) monitoring and inputting the arrangement order of RFID tags in the database;

(d) reading an RFID tag at an optional point (objective RFID tag) by use of an RFID reader; and (e) monitoring that the objective RFID tag is an RFID tag located on $n^{th}$ from the RFID tag located on the head (a) and confirming that the objective RFID tag is located at L from the head (a) where L is resulted from multiplying n and d.

2. The method of claim 1, further comprising monitoring and input IDs of RFID tags in the database and to assign IDs of the RFID tags and their corresponding zone IDs and match them after step (c).

3. The method of claim 2, wherein the zone IDs comprises information on the name of area where RFID tags of RFID series installed on the road according to an administrative district or the distance of the concerned RFID tags from the head RFID tag of RFID series installed on the road.

* * * * *